US011825869B2

(12) United States Patent
Zappoli

(10) Patent No.: US 11,825,869 B2
(45) Date of Patent: Nov. 28, 2023

(54) METHOD FOR THE PRODUCTION OF SHEET-LIKE TOBACCO MATERIAL

(71) Applicant: PHILIP MORRIS PRODUCTS S.A., Neuchatel (CH)

(72) Inventor: Stefano Zappoli, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 333 days.

(21) Appl. No.: 16/605,829

(22) PCT Filed: Apr. 13, 2018

(86) PCT No.: PCT/EP2018/059578
§ 371 (c)(1),
(2) Date: Oct. 17, 2019

(87) PCT Pub. No.: WO2018/192859
PCT Pub. Date: Oct. 25, 2018

(65) Prior Publication Data

US 2020/0138095 A1 May 7, 2020

(30) Foreign Application Priority Data

Apr. 19, 2017 (EP) ..... 17166971

(51) Int. Cl.
*A24B 3/14* (2006.01)
*A24D 3/02* (2006.01)

(52) U.S. Cl.
CPC ..... *A24B 3/14* (2013.01); *A24D 3/0204* (2013.01)

(58) Field of Classification Search
None
See application file for complete search history.

(56) References Cited

U.S. PATENT DOCUMENTS 3,173,426 A 3/1965 Touey
6,739,024 B1 * 5/2004 Wagner ..... D04H 3/14 26/7

(Continued)

FOREIGN PATENT DOCUMENTS

CN 201577521 9/2010
CN 202618265 12/2012

(Continued)

OTHER PUBLICATIONS

PCT Search Report and Written Opinion for PCT/EP2018/059501.
Office Action issued in China for Application No. 02180014126.0 dated Jun. 3, 2021(19 pages). English translation included.

*Primary Examiner* — Kelly M Gambetta
*Assistant Examiner* — Katherine A Will
(74) *Attorney, Agent, or Firm* — Mueting Raasch Group

(57) ABSTRACT

The invention relates to an apparatus and a method of manufacturing a crimped sheet (70) of material for an aerosol-generating article. The method comprises the step of feeding a substantially continuous sheet of material to a set of crimping rollers (11, 21) in a transport direction (1), the set of crimping rollers comprising a first roller (11) having a first surface (12) and having a first plurality of ridges (17) across at least a portion of its width and a second roller having a second surface, the second surface (22) being formed at least for a portion thereof in a material having an hardness lower than the hardness of a material forming the first surface. Further, the method comprises crimping the substantially continuous sheet of material to form the crimped sheet by feeding the substantially continuous sheet between the first and second rollers in the transport direction of the sheet such that the corrugations of the first roller apply a plurality crimp corrugations to the substantially continuous sheet.

18 Claims, 7 Drawing Sheets

(56) References Cited

U.S. PATENT DOCUMENTS

| | | | | |
|---|---|---|---|---|
| 10,888,118 | B2 | 1/2021 | Pijnenburg | |
| 10,905,155 | B2 | 2/2021 | Ferrazzin | |
| 2006/0053593 | A1* | 3/2006 | Gombash | D01G 7/00 19/66 T |
| 2017/0151765 | A1 | 6/2017 | Ohman | |

FOREIGN PATENT DOCUMENTS

| | | |
|---|---|---|
| CN | 105473010 | 4/2016 |
| CN | 106535668 | 3/2017 |
| CN | 106660313 | 5/2017 |
| GB | 1 001 813 | 8/1965 |
| GB | 1 047 166 | 11/1966 |
| KR | 1019950002453 | 3/1995 |
| WO | WO 2016/023965 | 2/2016 |

* cited by examiner

METHOD FOR THE PRODUCTION OF SHEET-LIKE TOBACCO MATERIAL

This application is a U.S. National Stage Application of International Application No. PCT/EP2018/059578 filed Apr. 13, 2018, which was published in English on Oct. 25, 2018 as International Publication No. WO 2018/192859 A1. International Application No. PCT/EP2018/059578 claims priority to European Application No. 17166971.6 filed Apr. 19, 2017.

This invention relates to a process for producing sheet-like tobacco material. In particular, the invention relates to a process for producing sheet-like tobacco material for use in an aerosol-generating article such as, for example, a cigarette or a "heat-not-burn" type tobacco containing product.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The most commonly used forms of homogenized tobacco material are reconstituted tobacco sheet and cast leaf. The process to form homogenized tobacco material sheets commonly comprises a step in which tobacco dust and a binder are mixed to form a slurry. The slurry is then used to create a tobacco web, for example by casting a viscous slurry onto a moving metal belt to produce so called cast leaf. Alternatively, a slurry with low viscosity and high water content can be used to create reconstituted tobacco in a process that resembles paper-making. Once prepared, homogenized tobacco webs may be cut in a similar fashion as whole leaf tobacco to produce tobacco cut filler suitable for cigarettes and other smoking articles. The function of the homogenized tobacco for use in conventional cigarettes is substantially limited to physical properties of tobacco, such as filling power, resistance to draw, tobacco rod firmness and burn characteristics. This homogenized tobacco is typically not designed to have taste impact. A process for making such homogenized tobacco is for example disclosed in European Patent EP 0565360.

In a typical manufacturing process of aerosol generating articles, at least one component comprises a material, usually in a sheet or foil format, that goes through a crimping process. The crimped material is then compressed into a rod which is cut into parts, usually tubular, called "sticks". These sticks are components of the aerosol generating articles.

While the crimping process is helpful for compressing and folding the sheet of material into sticks that will fit into the aerosol generating articles, the crimping process may also influence the amount of air contact, the Resistance To Draw (RTD), or others, and, hence, it is directly experienced by the users of the aerosol generating articles.

As a consequence, applying an adequate crimping pressure may be an important parameter of the crimping process. While a too low crimping pressure may decrease the positive effects of the crimping, a too high pressure could damage the sheet of material or decrease its tensile strength, which in turn may increase tearing occurrence and can even shred it.

The crimping process commonly uses two rotating cylindrical rollers between which the sheet of material is pressed. These rollers have matching textured ridge-and-trough patterns on their outside surfaces that crimp the sheet.

The overall production process preferably runs at high speed. The shorter the crimping time, the more pressure has to be applied to assure a proper crimping of the sheet of material, which increases the risk to damage the sheet during the crimping process. There is therefore a need for a method for crimping a sheet of material having an improved consistency in the final product in particular when high crimping speeds are used.

The invention relates to a method of manufacturing a crimped sheet of material for an aerosol-generating article, the method comprising the step of feeding a substantially continuous sheet of material to a set of crimping rollers in a transport direction, the set of crimping rollers comprising a first roller having a first surface and having a first plurality of ridges across at least a portion of its width and a second roller having a second surface, the second surface being formed at least for a portion thereof in a material having an hardness lower than the hardness of a material forming the first surface; and further comprising the step of crimping the substantially continuous sheet of material to form the crimped sheet by feeding the substantially continuous sheet between the first and second rollers in the transport direction of the sheet such that the corrugations of the first roller apply a plurality of crimp corrugations to the substantially continuous sheet.

The invention describes the use of two rollers for crimping a sheet of material, in particular for the production of an aerosol generating article. The pair of rollers includes a first and a second roller, where the first roller has a corrugation pattern defined by ridges on its surface and the second roller has a softer surface than the first roller. The second roller acts as a counter roller for the first roller, so as to prevent over-crimping of the sheet of material. In a usual crimping process where the sheet of material runs between two rollers both having ridges, overextended areas may be created in the sheet of material, because when the sheet is pressed by a ridge of one roller into a trough of the other roller, the material forming the sheet may be lengthened in the trough.

According to the nature of the material of the sheet, in particular a tobacco cast leaf, such overextended areas could be quite localized or not. In the overextended areas, the sheet can become very thin compared to the overall thickness of the sheet, especially in areas corresponding to the top of the ridge and in the bottom of the trough where it is compressed, thus bending lines may form. These bending lines may be considered as weak parts of the sheets that can be torn during further processing in case of tension in the sheet of material, leading to shredding of parts of the material. This shredding may cause the formation of moving particles within a rod of material formed gathering the crimped sheet. This phenomenon is known as fly-out effect, and it may cause a negative user experience when the user is smoking the aerosol generating article including the rod.

As used herein, the term "aerosol-generating article" refers to an article comprising an aerosol-forming substrate that is capable of releasing volatile compounds that can form an aerosol, for example by heating, combustion or a chemical reaction. As used herein, the term 'aerosol-forming substrate' is used to describe a substrate capable of releasing volatile compounds, which can form an aerosol. The aerosols generated from aerosol-forming substrates of aerosol-generating articles according to the invention may be visible or invisible and may include vapours (for example, fine particles of substances, which are in a gaseous state, that are ordinarily liquid or solid at room temperature) as well as gases and liquid droplets of condensed vapours.

An aerosol-generating article may be a heated aerosol-generating article, which is an aerosol-generating article comprising an aerosol-forming substrate that is intended to be heated rather than combusted in order to release volatile compounds that can form an aerosol. A heated aerosol-generating article may comprise an on-board heating means forming part of the aerosol-generating article, or may be configured to interact with an external heater forming part of a separate aerosol-generating device.

An aerosol-generating article may resemble a combustible smoking article, such as a cigarette. An aerosol-generating article may comprise tobacco or other plant-based material. Plant-based material preferably includes alkaloids. An aerosol-generating article may be disposable. An aerosol-generating article may alternatively be partially-reusable and comprise a replenishable or replaceable aerosol-forming substrate.

Preferably, the aerosol-forming substrate is formed from or comprises a homogenised tobacco material having an aerosol former content of greater than about 5 percent on a dry weight basis and water. For example the homogenised tobacco material may have an aerosol former content of between about 5 percent and about 30 percent by weight on a dry weight basis. An aerosol generated from such aerosol-forming substrates may be perceived by a user to have a particularly high temperature and the use of a high surface area, low resistance to draw aerosol-cooling element may reduce the perceived temperature of the aerosol to an acceptable level for the user.

The aerosol-generating article may be substantially cylindrical in shape. The aerosol-generating article may be substantially elongate. The aerosol-generating article may have a length and a circumference substantially perpendicular to the length. The aerosol-forming substrate may be substantially cylindrical in shape. The aerosol-forming substrate may be substantially elongate. The aerosol-forming substrate may also have a length and a circumference substantially perpendicular to the length. The aerosol-forming substrate may be received in the aerosol-generating device such that the length of the aerosol-forming substrate is substantially parallel to the airflow direction in the aerosol-generating device. The aerosol-cooling element may be substantially elongate. The aerosol-generating article may have a total length between approximately about 30 millimeters and approximately about 100 millimeters. The aerosol-generating article may have an external diameter between approximately about 5 millimeters and approximately about 12 millimeters.

The aerosol-generating article may comprise a filter or mouthpiece. The filter may be located at the downstream end of the aerosol-generating article. The filter may be a cellulose acetate filter plug. The filter is approximately about 7 millimeters in length in one embodiment, but may have a length of between approximately about 5 millimeters and approximately about 10 millimeters. The aerosol-generating article may comprise a spacer element located downstream of the aerosol-forming substrate.

As used herein, the term "homogenised tobacco material" denotes material formed by agglomerating particulate tobacco.

A homogenised tobacco material may be in the form of a sheet. The homogenised tobacco material may have an aerosol-former content of greater than about 5 percent on a dry weight basis. The homogenised tobacco material may alternatively have an aerosol former content of between about 5 percent and about 30 percent by weight on a dry weight basis. Sheets of homogenised tobacco material may be formed by agglomerating particulate tobacco obtained by grinding or otherwise comminuting one or both of tobacco leaf lamina and tobacco leaf stems; alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco; alternatively, or in addition, sheets of homogenised tobacco material may comprise other additives including, but not limited to, tobacco and non-tobacco fibres, aerosol-formers, humectants, plasticisers, flavourants, fillers, aqueous and nonaqueous solvents and combinations thereof.

As used herein, the term "sheet" denotes a laminar element having a width and length substantially greater than the thickness thereof.

As used herein, the term "crimped" denotes a sheet or web with a plurality of corrugations.

As used herein, the term "corrugations" denotes a plurality of substantially parallel ridges formed from alternating peaks and troughs joined by corrugation flanks. This includes, but is not limited to, corrugations having a square wave profile, sinusoidal wave profile, triangular profile, sawtooth profile, or any combination thereof.

As used herein, the term "crimp corrugations" refers to the corrugations on a crimped sheet or web.

As used herein, the term "substantially interleave" denotes that the corrugations of the first and second rollers at least partially mesh. This includes arrangements in which the corrugations of one or both of the rollers are symmetrical or asymmetrical. The corrugations of the rollers may be substantially aligned, or at least partially offset. The peak of one or more corrugations of the first or second rollers may interleave with the trough of a single corrugation of the other of the first and second rollers. Preferably, the corrugations of the first and second rollers interleave such that substantially all of the corrugation troughs of one of the first and second rollers each receive a single corrugation peak of the other of the first and second rollers.

As used herein, the term "longitudinal direction" refers to a direction extending along, or parallel to, the length of a sheet or web.

As used herein, the term "width" refers to a direction perpendicular to the length of a web or sheet, or in the case of a roller, parallel to the axis of the roller.

As used herein, the term "pitch value" refers to the lateral distance between the troughs at either side of the peak of a particular corrugation.

As used herein, the term "rod" denotes a generally cylindrical element of substantially circular or oval cross-section.

As used herein, the terms "axial" or "axially" refer to a direction extending along, or parallel to, the cylindrical axis of a rod.

As used herein, the terms "gathered" or "gathering" denote that a web or sheet is convoluted, or otherwise compressed or constricted substantially transversely to the cylindrical axis of the rod.

As used herein, the term "amplitude value" refers to the height of a corrugation from its peak to the deepest point of the deepest directly adjacent trough.

The method of the invention is used to crimp a sheet of material. For example, such a sheet could be a sheet of homogenized tobacco material. In order to crimp the sheet, the apparatus includes a first and a second roller between which the crimping of the sheet takes place. Between the first roller and the second roller, the sheet of material is inserted in order to crimp the sheet, that is, in order to form corrugations on the same according to a given pattern. The sheet of material is inserted between the two rollers along its longitudinal direction.

The corrugations according to the given pattern are formed by means of ridges formed on an external surface, called first surface in the following, of the first roller. The ridges are generally more than one and define a first plurality.

Ridges may also be realized on an external surface of the second main roller, called second surface, and define a second plurality of ridges.

Preferably, the ridges of the first or of the second plurality are parallel one to the other.

Preferably, ridges of the first or second plurality extend circumferentially around the first or second surface.

The ridges of the first or second plurality may be formed in the whole external surface of the first or second roller or only in a part thereof, for a given width of the surface.

Each roller defines a rotation axis around which the roller (first roller or second roller) is adapted to rotate. The first or second roller may have a cylindrical shape. In this case, the rotation axis coincides with the axis of the cylinder.

The ridges of the first or second plurality can be perpendicular to the rotation axis or can be even slightly inclined with respect to the same.

The ridges of the first or second plurality may have a constant pitch value.

Preferably, the ridges of the first or second plurality have a constant amplitude along their extension, and even more preferably this constant amplitude is the same for all ridges in a roller. However, the amplitude of the ridges of the first plurality may differ from the amplitude of the ridges of the second plurality.

Preferably, if both first and second roller include ridges, the ridges of the first and second plurality interleave. Therefore, when the sheet of material is inserted between the first and the second rollers, the first and second plurality of ridges form corrugations onto both surfaces of the sheet. The corrugations have a given pattern which depends, among others, on the amplitude of the first and second plurality of ridges and on their pitches, as well as on the distance between the first and the second roller.

The first roller may comprise ridges. The second roller may not comprise ridges. If only the first roller comprises ridges, when the sheet of material is inserted between the first and the second roller, the first plurality of ridges forms corrugation on one of the two surfaces of the sheet. The corrugations may have a given pattern which depends, among others, on the amplitude of the first plurality of ridges and on their pitch, as well as on the distance between the first and the second roller.

According to the invention, at least a portion of the surface of the first roller, on which the first plurality of ridges is formed, is preferably realized in a relatively "hard" material, while at least a portion the surface of the second roller, on which the second plurality of ridges may or may not be formed, is formed in a "soft" material. The hardness of at least a portion of the material forming the first surface is higher than the hardness of at least a portion of the material forming the second surface. More preferably, the whole first surface is formed in a material having a higher hardness than the material forming the whole second surface. The material forming the first or second surface does not need to be everywhere the same, portions of different materials may be formed in the first or in the second surface.

"Hardness" is a measure of how resistant solid matter is to various kinds of permanent shape change when a compressive force is applied.

Advantageously, a combination of a corrugated hard first roller and a smooth softer counter second roller creates bending lines on the sheet that help compressing the material from a sheet format to a rod format, while preventing overextending and damaging the material being crimped. Such soft material on at least a portion of the surface of the second roller helps the sheet of material to dissipate at least a part of the mechanical pressure exerted by the ridges of the first roller during the crimping process. The ridges of the first roller may generate stable bending lines in the sheet of material.

Due to the fact that there is no or only minimal overextension of the material, it is then possible to ensure that the sheet of material is not shredded, or only minimally, by fixing a minimum thickness of the sheet. The minimum thickness of the sheet is defined by the minimum distance between the first and the second roller. For example, if the second roller includes a smooth surface without ridges, the minimum distance is a distance between the tip of a ridge of the first roller and the flat surface of the second roller. Fixing this minimum distance above a specific threshold value under which the material of the sheet becomes fragile and prone to shredding may further minimize the fly-out phenomenon.

Preferably, the thickness of the sheet is comprised between about 0.15 millimeters and about 0.4 millimeters. More preferably, it is comprised between about 0.18 millimeters and 0.3 millimeters. More preferably, it is of about 0.2 millimeters.

Advantageously, the portion of the first surface of the first roller having a higher hardness than a portion of the second surface of the second roller is realized in metal. The metal forming the first surface may be steel. Preferably, the first plurality of ridges is realized in steel as well. Preferably, the whole first surface is realized in metal.

Favourably, the portion of the second surface of the second roller is realized in rubber.

More preferably, the whole second surface is realized in rubber. The large difference in hardness between at least portions of the surfaces of two rollers allows for a reliable crimping of the sheet of material. For instance, the rubber consists of or comprises polyurethane.

Preferably, the second surface of the second roller includes a portion realized in metal and a portion realized in rubber. The second surface does not need to be formed in the same material.

Advantageously, the method includes the step of coating the second roller with a first layer of a material having a first hardness and coating the first layer with a second layer of material having a second hardness. When the first roller including the first plurality of ridges presses onto the sheet of material, which in turn presses against the second roller, this compression may create bending lines—or compressed areas—on the sheet. The portions of the sheet including the bending lines are thinner comparing to the overall thickness of the sheet. Slight bumps adjacent to these bending lines may be created by the deformation of the less hard second roller surface under the pressure exerted by the ridges on the sheet. The deformation is transmitted to the compressed sheet in contact with the second surface, so that the bumps are formed. If the top layer is harder than the layer beneath it, then a bump formed by the pressing ridges of the first roller may result less localized. The second surface of the second roller may be made of more than two layers of material having different hardness, each layer having a specific hardness, so as to create different compression shapes on the sheet material being pressed during the crimping process.

Preferably, the second roller has a smooth second surface. Preferably, the second surface, that is, the outer surface of the second roller, does not include ridges. This allows for a gentle crimping of the sheet of material in cooperation with a hard crimping first roller and may help to reduce or avoid damage to the sheet of material during the crimping process. Favourably, it is possible to fix a minimum distance between the tip of the ridges of the first roller with corrugation pattern and the flat surface of the second roller, and so to fix a minimum thickness of the sheet after crimping.

Advantageously, the second roller includes a plurality of helical ridges. The plurality of helical ridges may be formed by a layer of material wrapped around the second surface.

For example, the second surface may be made of two materials: a first material with relatively high hardness (such as steel), and a second material with lower hardness (such as rubber), provided in helical bands around the second roller, so as to create angled bands of less (or even not) crimped sheet after crimping. Such embodiment could reinforce the sheet for the further manufacturing processes as the less (or not) crimped bands may not lower the tensile strength of the sheet before crimping. Such less textured bands can provide an attachment function for shreds if the sheet, such as a homogenized tobacco sheet, is overcrimped. This allows an even more gentle crimping process, as the material between the ridges is crimped less. The helical structure of the less crimped areas between the ridges can effectively bind particles which inadvertently were detached in the sheet of material and could cause an undesired fly-out effect. These areas of uncrimped or less crimped material in the sheet hold or anchor the other crimped parts of the sheet, including the parts that otherwise could or would be shredded when classical rollers used for crimping were employed. Such undesired shredded parts may, when the sheet is gathered and compressed as rod or stick and inserted in the smoking article, travel inside the smoking article, known in the art as the "fly-out" effect, thus disturbing the users smoking experiences. Hence, according to the invention, while a good tensile strength is maintained the crimping output is made without such travelling fly-out parts and an increased consistency in the product is achieved. In particular, the resistance against fly-out can be improved by at least about 30 percent, preferably by at least about 40 percent, more preferably by about 50 percent.

Advantageously, the sheet of material is one of: a homogenized tobacco sheet, a plastic sheet or a sheet including cellulose. The sheet can be processed with high speed in the crimping process, having an improved consistency in the product in particular when high crimping speeds are used.

Preferably, the crimped sheet of material is gathered and a rod is formed using the gathered crimped sheet of material. The crimp corrugations of the crimped sheet define a plurality of channels in the rod-shaped component. In particular, wrapping the rod is preferably performed after forming the rod. The rod has an improved consistency in particular when high crimping speeds are used.

Advantageously, the method includes cutting the continuous rod into a plurality of rod-shaped components, each rod-shaped component having a gathered crimped sheet formed from a cut portion of the crimped sheet, the crimp corrugations of the crimped sheet defining a plurality of channels in the rod-shaped component.

Preferably, the hardness of a portion of the surface of the first roller is advantageously comprised between about 48 HRC and about 58 HRC. More preferably, the hardiness of a portion of the surface of the first roller is advantageously comprised between about 50 HRC and about 54 HRC. Indentation hardness tests are used in mechanical engineering to determine the hardness of a material to deformation. Several such tests exist, wherein the examined material is indented until an impression is formed; these tests can be performed on a macroscopic or microscopic scale. The Rockwell scale is a hardness scale based on indentation hardness of a material. The Rockwell test determines the hardness by measuring the depth of penetration of an indenter under a large load compared to the penetration made by a preload. There are different scales, denoted by a single letter, that use different loads or indenters. The result is a dimensionless number noted as HRA, HRB, HRC, etc., where the last letter is the respective Rockwell scale. The determination of the Rockwell hardness of a material involves the application of a minor load followed by a major load. The minor load establishes the zero position. The major load is applied, then removed while still maintaining the minor load. The depth of penetration from the zero datum is measured from a dial, on which a harder material gives a higher number. That is, the penetration depth and hardness are inversely proportional. The chief advantage of Rockwell hardness is its ability to display hardness values directly, thus obviating tedious calculations involved in other hardness measurement techniques.

The equation for Rockwell Hardness is $$HR = N - \frac{d}{s},$$

where d is the depth (from the zero load point), and N and s are scale factors that depend on the scale of the test being used (see following section).

There are several alternative scales. They express hardness as an arbitrary dimensionless number. A properly used Rockwell designation has the hardness number followed by "HR" (Hardness Rockwell), which will be followed by another letter which indicates the specific Rockwell scale. An example is 60 HRB, which indicates that the specimen has a hardness reading of 60 on the B scale.

In testing "hard" materials, such as hard cast iron and many steel alloys, a 120 degrees diamond cone is used with up to a 150 kilogram load and the hardness is read on the "C" scale. The Rockwell test uses two loads, one applied directly after the other. The first load, known as the "minor", load of 10 kilograms is applied to the specimen to help seat the indenter and remove the effects, in the test, of any surface irregularities. In essence, the minor load creates a uniformly shaped surface for the major load to be applied to.

The difference in the depth of the indentation between the minor and major loads provides the Rockwell hardness number.

The first roller has ist surface preferably realized in a relatively "hard" material, the hardness of which is measured according to the scale "C".

Preferably, the hardness of a portion of the surface of the second roller is advantageously comprised between about 70 and about 94 SHORE A at 25 degree Celsius. More preferably, the hardness of a portion of the surface of the second roller is advantageously comprised between about 75 and about 90 SHORE A at 25 degree Celsius, even more preferably the hardness of a portion of the surface of the second roller is advantageously comprised between about 79 and about 84 SHORE A at 25 degree Celsius. The shore hardness is another measure of the hardness of the material. It is made using a durometer. Durometer is typically used as a measure of hardness in polymers, elastomers, and rubbers.

There are several scales of durometer, used for materials with different properties. The two most common scales, using slightly different measurement systems, are the ASTM D2240 type A and type D scales. The A scale is for softer plastics, while the D scale is for harder ones. Each scale results in a value between 0 and 100, with higher values indicating a harder material.

Durometer, like many other hardness tests, measures the depth of an indentation in the material created by a given force on a standardized presser foot. This depth is dependent on the hardness of the material, its viscoelastic properties, the shape of the presser foot, and the duration of the test. ASTM D2240 durometers allows for a measurement of the initial hardness, or the indentation hardness after a given period of time. The basic test requires applying the force in a consistent manner, without shock, and measuring the hardness (depth of the indentation). If a timed hardness is desired, force is applied for the required time and then read.

The material under test should be a minimum of 6.4 mm (0.25 inches) thick.

The second roller is rather "soft" and this scale is preferably used.

Preferably, the surface of the first roller has a portion that it as least twice as hard as a portion of the surface of the second roller. More preferably, the portion of the surface of the first roller is at least 10 times, preferably 100 times, even more preferably 200 times, harder than the portion of the surface of the second roller.

Preferably, the method includes selecting a distance between the first and the second roller depending on the material of the sheet. As mentioned, the distance between the rollers determines, among others, the minimum thickness of the sheet after crimping. This minimum thickness may be selected depending on the material forming the sheet, which may withstand different stresses.

The invention will be further described, by way of example only, with reference to the accompanying drawings in which.

Figure 4:
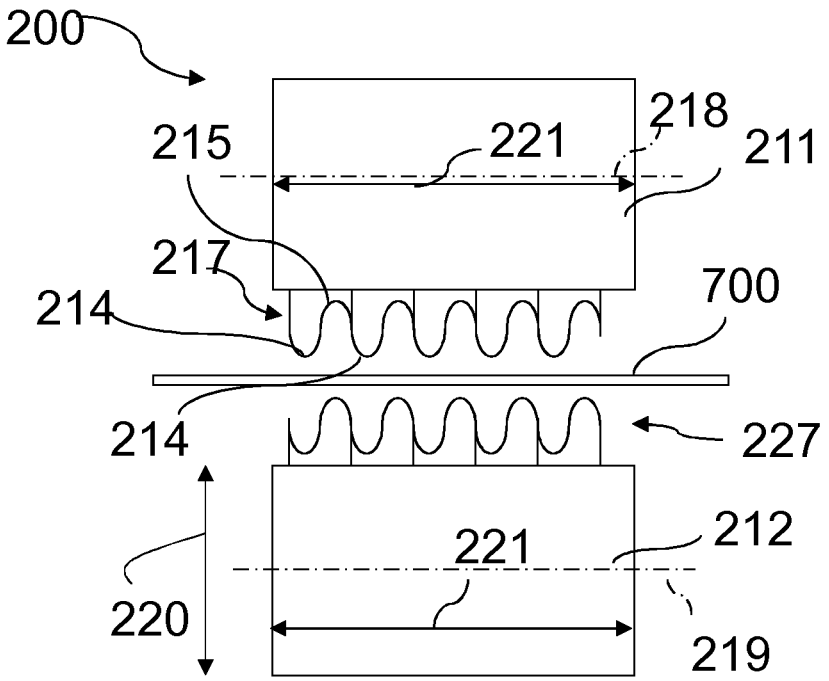
FIG. 4 shows a two conventional crimping rollers.
Figure 5:
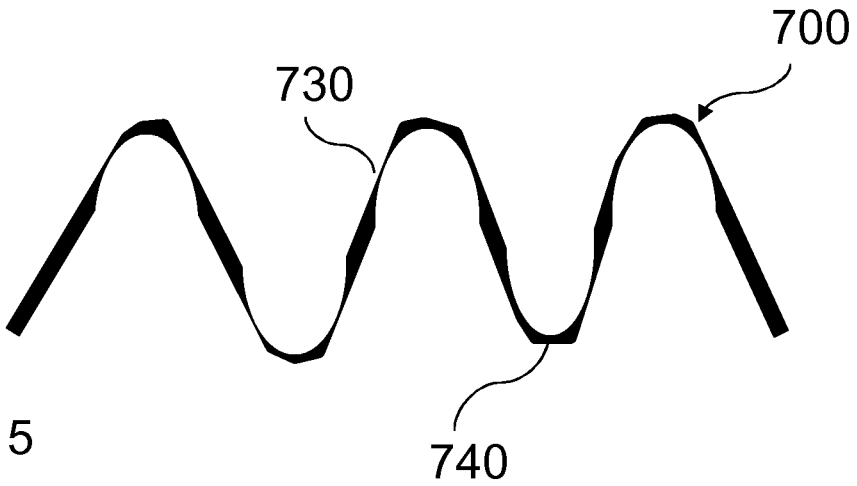
FIG. 5 shows a crimped sheet of material treated by conventional crimping rollers of FIG. 4, comprising over-extended areas prone to shredding.

For comparative purposes, in FIGS. 4 and 5 an apparatus 200 realized according to the prior art to crimp a sheet of material 70 and the crimped sheet of material are shown.

FIG. 4 shows a partial view of two mutually facing crimping rollers 211, 212 including interleaving corrugations 217, 227 (depicted in an exaggerated manner for clarity) in a side view. Each roller 211, 212 rotates around a respective axis 218, 219. Both rollers 211, 221 have the same diameter 220 and width 221. Each roller 211, 212 includes a conventional ridge-and-trough pattern as corrugation 217, 227. The corrugation or ridge-and-trough pattern 217, 227 is comprised of circumferential ridges, each ridge defining a ridge amplitude. The ridges of the first and second roller have identical amplitude and pitch. Further, each ridge of the corrugations 217, 227 includes a top portion or tip 214 and a concave through 215 is positioned between two adjacent ridges.

FIG. 5 shows a crimped sheet 700 of material treated by the conventional crimping rollers 211, 212 of the apparatus 200 realized according to the prior art as shown in FIG. 4. The crimped sheet 700, comprising overextended areas 730, 740 prone to shredding. As visible in the drawings, the overextended areas 730, 740 are extremely thin compared with the other areas of the sheet 700.

According to the nature of the material of the sheet 700, such overextended areas 730, 740 could be quite localized or not, and are formed usually in corresponding areas to those where the top 214 of the ridges are positioned.

These extra-thin/over-extended areas 730, 740 may create bending lines in the sheet 700 at top and bottom surfaces of the crimped sheet, as illustrated in FIG. 5. These extra-thin bending lines, thin compared to the overall thickness of the sheet 700, are weak parts that can get torn during further processing in case of tension in the material, leading to shredding of parts of the sheet 700, and so to moving particles in the rod material ("fly-out" effect), creating negative user experience when using a final product, such as an aerosol generating article (not shown in the drawings) formed using the crimped sheet 700.

Figure 1:
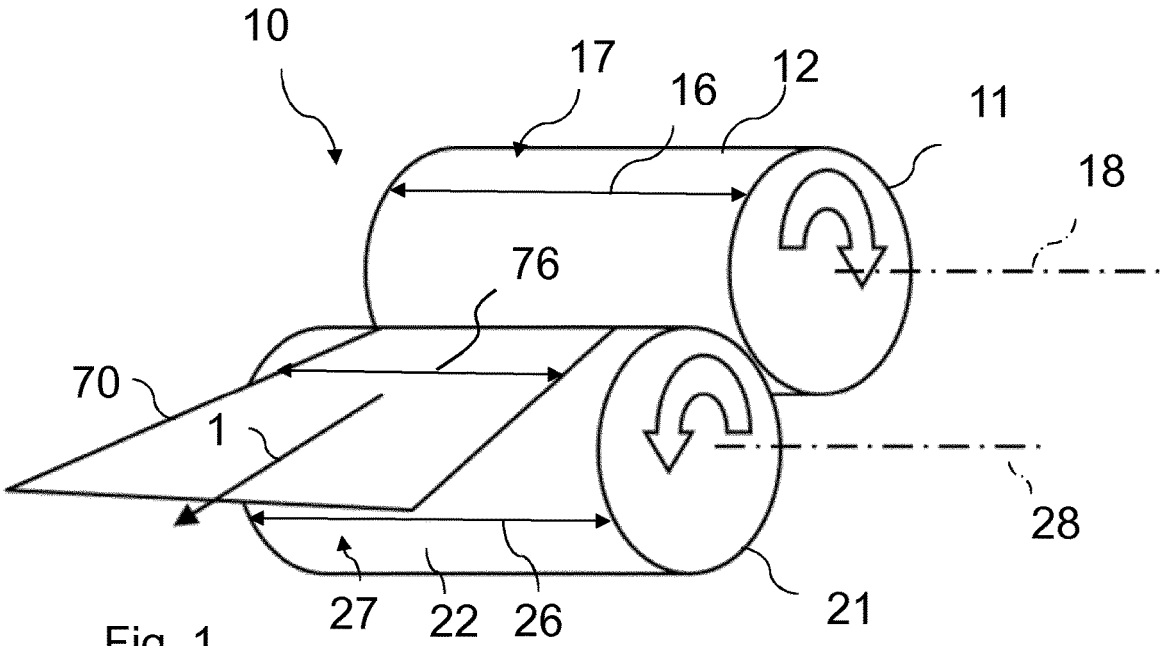
FIG. 1 shows an isometric view of an apparatus having two main rollers and a pre-crimping roller between which a sheet of material is treated according to the invention.

With now reference to FIG. 1, an isometric view of a first embodiment of an apparatus 10 to crimping a sheet of material 70 according to the invention is depicted. The apparatus 10 comprises a first and second facing crimping rollers 11, 21 between which the sheet 70 of material having the width 76 is treated according to the invention. The transport direction 1 of the sheet 70 is indicated with an arrow 1 in the FIG. 1.

The first and second facing roller 11, 21 define a first and second rotation axis 18, 28, respectively. The surface 12 of the first roller 11 is provided with corrugations 17 (not clearly visible in FIG. 1), forming a ridge- and trough pattern, which include typically circumferential ridges on the surface 12 of the first roller 11. The circumferential ridges may be perpendicular with respect to the rotation axes 18, 28 or may be slightly inclined.

Figure 6:
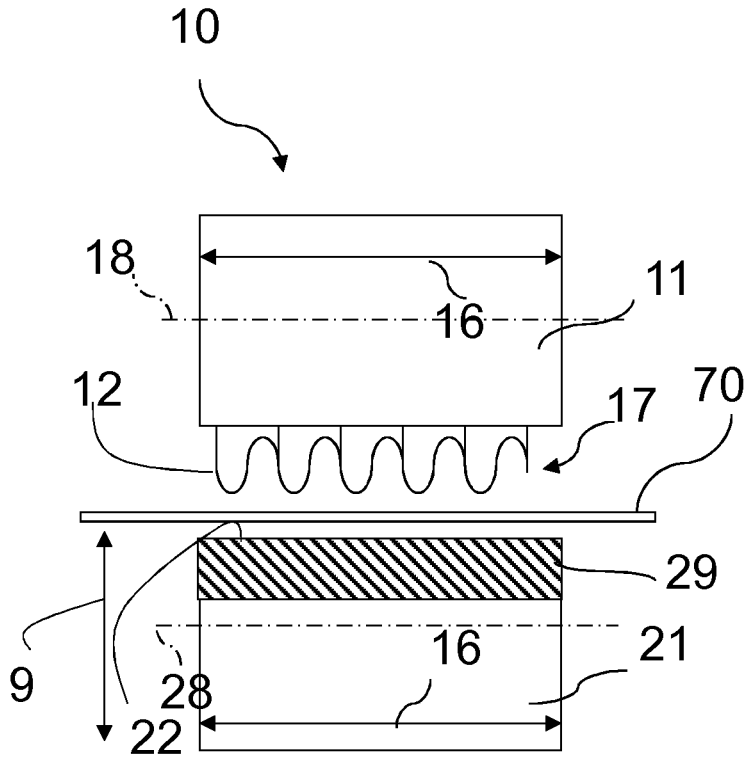
FIG. 6 shows a corrugated crimper roller and a counter roller comprising a smooth and soft surface according to an embodiment of the invention.

Both rollers 11, 21 have the same diameter 16 and width 9 (visible in FIG. 6).

The second roller 21 has a smooth surface 22, which is softer than the surface 12 of the first roller 11, that is, the hardness of the material forming the second surface 22 is lower than the hardness of the material forming the first surface 12 of the first roller. Typically, the counter roller 21 comprises at least a portion of the second surface 22 made of rubber.

The corrugations 17 of the first roller 11 are symmetrical or asymmetrical.

The two rollers 11, 21 are used for crimping a sheet of material 70, such as a homogenized tobacco sheet, so as to prevent overcrimping of the sheet 70.

Figure 2:
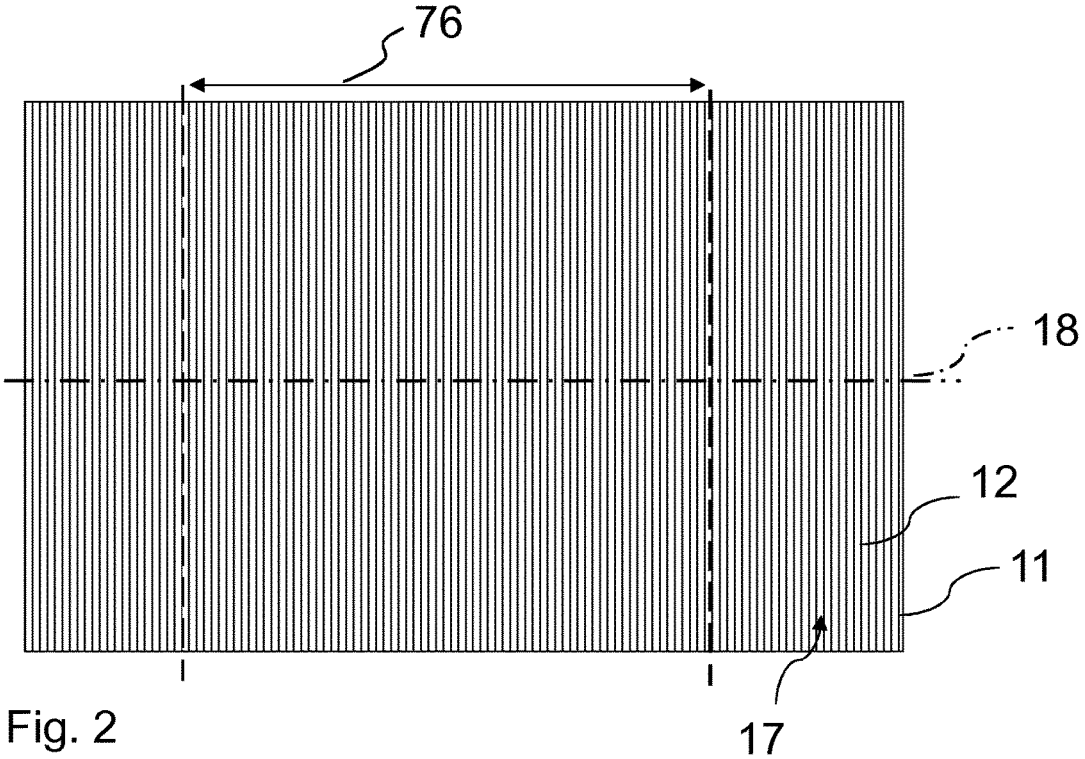
FIG. 2 shows a two-dimensional representation of a surface of a roller having a ridge-and-trough pattern used in the inventive method.

As can be seen in FIG. 2, where the first roller 11 is depicted as a two dimensional area for clarity, the first surface 12 of the roller 11 has a conventional ridge-and-trough pattern as corrugation 17. The ridge-and-trough pattern 17 is comprised of circumferential ridges, each ridge defining a ridge amplitude. The ridges can be oriented perpendicular to the rotation axis 18 or can be slightly inclined, e.g. by not more than 10°.

The crimping on the sheet 70 is characterized among others by the number of lines of the corrugation pattern of the main crimping roller 11 and the depth of the troughs and the amplitude of the ridges of the corrugations 17.

FIG. 6 shows another—more detailed—view of the apparatus 10 to crimp the sheet of material 70 including the first and the second rollers 11, 21 of FIG. 1. Preferably the first roller 11 is realized in steel, while the second roller has also a steel core the surface of which is covered by a layer a soft material, for instance rubber.

As an example, the second roller 21 may be made of at least one layer 29 of rubber or a soft material around a hard core, for instance steel (the layer 29 is circonferential, however for clarity only one part of it is indicated). Such at least one soft surface helps the sheet 70 to dissipate part of the mechanical pressure of the ridges of the first crimping roller 11 pressing on it, and so helps even more the sheet 70 of not being damaged by the crimping.

For instance, the soft layer 29 may have one layer of rubber, preferably polyurethane with shore A hardness of about 82±2.

Figure 8:
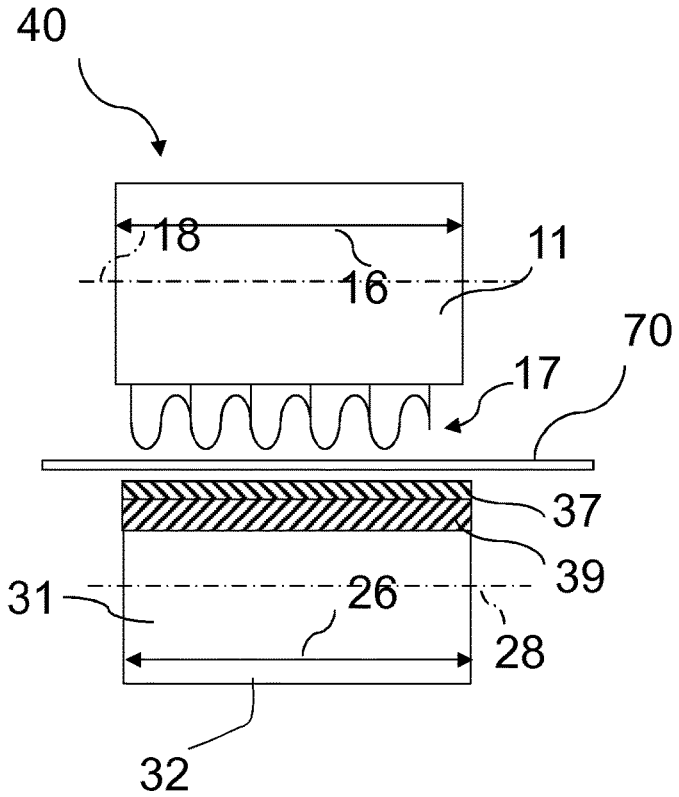
FIG. 8 shows a corrugated crimper roller and a counter roller comprising a smooth and soft surface consisting two soft surface layers according to an embodiment of the invention.

FIG. 8 illustrates a variant of the apparatus for crimping rollers, indicated with 40. Elements having an analog function as those described with reference to apparatus 10 are indicated with the same reference numerals. The apparatus 40 includes a first and a second roller 11, 31. The first roller 11 is substantially identical to the first roller described with reference to apparatus 10. The second roller 31 comprises a smooth and soft second surface 32 according to the invention. The smooth and soft surface 32 of the second roller 31 is composed of two soft surface layers 37, 39 arranged on top of each other.

The smooth surface 32 of the counter roller 31 may be made of more than two layers of soft material such as rubber, each having a specific hardness, so as to create different compression shapes on the material being pressed.

Of course, rubber as soft material on the second surface 32 second roller 31 can generally be replaced by another adequate soft material. The surface of the first roller 11 with corrugations 17 composed of ridges and troughs is made of a material harder or as hard as the surface 32 of the second roller 31.

Figure 9:
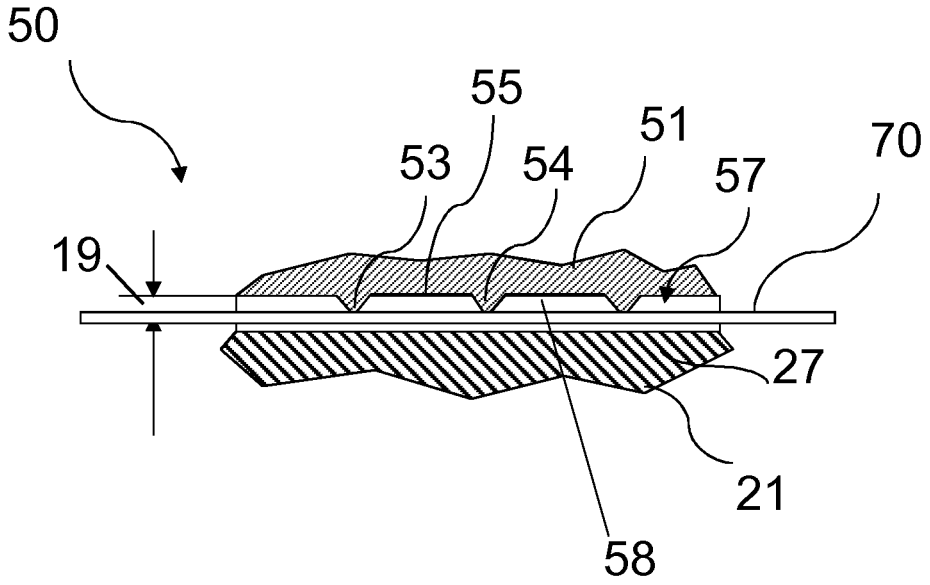
FIG. 9 shows a detail of a corrugated crimper roller and a counter roller comprising a smooth and soft surface having a soft surface according to an embodiment of the invention.

A third embodiment of an apparatus 50 to crimp sheet 70 is depicted in FIG. 9. In FIG. 9, only a portion of the apparatus is shown. The apparatus 50 includes first and second rollers 51, 21 to crimp the sheet 70. The second roller 21 is identical to the second roller of the first embodiment of apparatus 10. However, it may also be identical to the second roller 31 of the second embodiment of apparatus 40. The second roller 21 includes a flat smooth surface 22, "soft" compared to a surface of the first roller.

The first roller 51 comprises a plurality of ridges 57. A first and a second adjacent ridge of the plurality are indicated with 53 and 54. A through 55 is positioned between the two adjacent ridges 53, 54. The though 55 includes a flat surface portion 58. The amplitude 19 of the ridges 53, 54 is so selected to be lower than a minimal thickness of the sheet 70 under which the sheet becomes fragile. Therefore, during crimping, the sheet 70 abuts on, or contacts, the flat portions 58 in the trough 55 of the first crimping roller 51, so that the risk of cutting the sheet 70 or reaching below a minimum thickness of the sheet 70 is avoided. For instance, a maximum amplitude 19 of the ridges 53, 54 could be of about 0.1 millimeters when the sheet 70 is made of homogenized tobacco material with a typical thickness of about 0.2 millimeters. Of course, the dimensions can vary.

Figure 10:
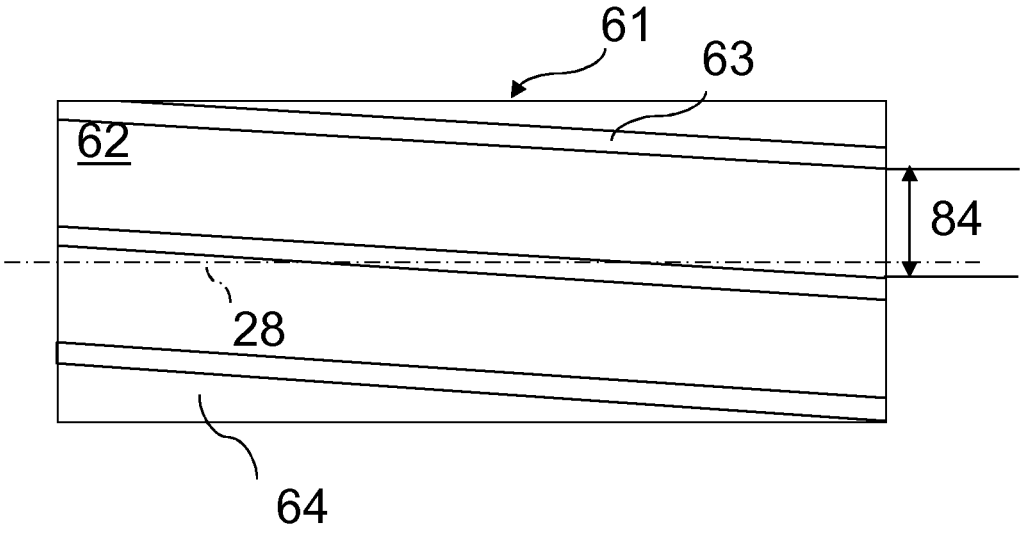
FIG. 10 shows a counter roller comprising a smooth surface with helical soft and hard bands.

In FIG. 10, a different embodiment of a second roller 61 or a crimping pair of roller is depicted. This second roller can be used in any of the apparatuses 10, 40, 50 above described. The second roller 61 has a surface 62 which includes two helical bands 63, 64 comprising different materials. A first material with great hardness, e.g. a metal such as steel, and a second material with a lower hardness than the hardness of the first material, such as rubber, are provided in the helical bands around the counter roller 21, so as to create angled bands of less crimped or even uncrimped material in a crimped sheet. The helical bands 63 of harder material act as helical ridges between the helical bands 64 of softer material.

Such a structure can reinforce the sheet of material for the further manufacturing processes as the less crimped or uncrimped bands in the sheet will maintain their tensile strength of the sheet before crimping. Such less textured bands can provide an attachment function for shreds if the sheet of material is overcrimped during the crimping process.

Figure 3:
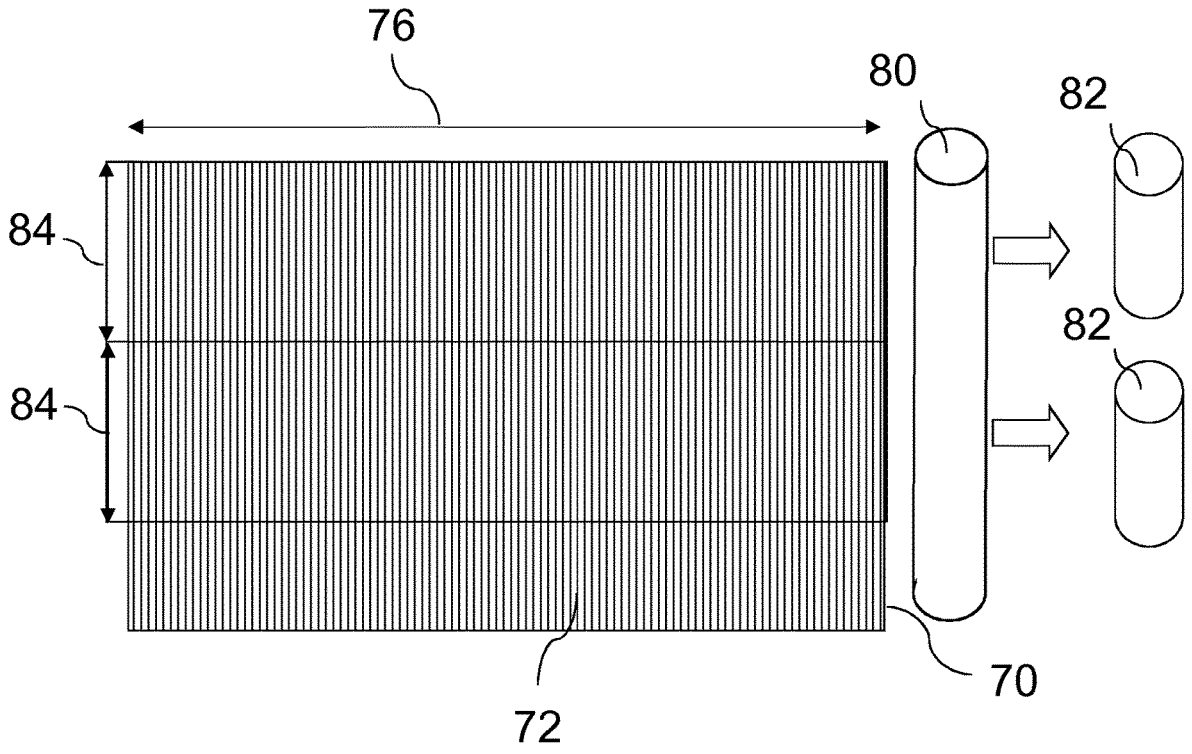
FIG. 3 shows a schematic top view of a crimped sheet according to the invention where gathering and forming a rod and sticks is indicated.

The helical bands may be arranged so that the spacing of the bands 63, 64 is not more than the final stick length 84 (FIG. 3). The helical bands in the sheet can limit the detachment of shreds or particles of the material in the aerosol-generating articles. In fact, since the spacing is preferably lower than the stick length 84, there will be mandatorily a band of less crimped or uncrimped sheet of material in the stick, acting as an anchoring portion for any shred, holding together the material in the stick.

Such combination creates bending lines while crimping on the sheet 70 that help compress the material from a sheet format to a rod format, while preventing overextending and damaging the material in the sheet 70 being crimped.

The diameter of the first or second crimping roller according to any of the above embodiments is comprised between about 25 centimeters and about 40 centimeters, and the speed of the sheet 70 as it reaches the rollers is between about 100 meters per minute and about 300 meters per minute so that an angular speed of the rollers is typically between about 80 revolutions per minute (rpm) and about 380 rpm.

Advantageously it is possible to fix a minimum distance between the tip of the ridges 17, 57 of the first roller 11, 51 with ridges and troughs and the smooth surface of the second roller 21, 31, 61 and so to fix a minimum thickness of the sheet 70 after crimping. Due to the fact that there is no over-extension of the material of the sheet 70, it is possible to ensure that the sheet 70 cannot be shredded by fixing this minimum thickness above a specific threshold value under which the material would become fragile otherwise.

The sheet 70 is crimped by any of apparatuses 10, 40, 50 in the following way. The sheet 70 runs on the first main roller 11,51 and is then transported between the two main rollers 11 or 51, 21, 31 or 61 for being crimped.

Usually the sheet 70 of material is about between about 0.1 millimeters and about 0.3 millimeters thick, and the average goal of crimping is to create bending lines having roughly half or less of the usual foil thickness. On a classic crimping roller such as the first roller 11, the ridges of the corrugations 17 have a bell shape, each with a total ridge height between about 0.4 millimeters and about 1.5 millimeters, a total width between about 0.4 millimeters and about 0.6 millimeters, and ridges are spaced about every about 0.5 millimeters and about 1 millimeter (pitch of the ridges).

Preferably, the sheet of material 70 is a homogenized tobacco sheet (cast leaf) or a PLA sheet.

The method of manufacturing a crimped sheet 70 of material for an aerosol-generating article, comprises the steps of feeding the substantially continuous sheet 70 of material to a set of first and second crimping rollers.

The surface of the sheet 70 shows corrugations which reproduce the corrugations on the surface of roller 11 in FIG. 2, or 51 of FIG. 9, as well as the combination of corrugations of rollers 11 or 51 and roller 61 of FIG. 10, for instance. The crimped sheet 70 of material is gathered and formed into a rod 80 by bending the crimped sheet 70 about the bending lines created by the crimping process. The crimp corrugations of the crimped sheet 70 define a plurality of channels in the rod 80. The rod 80 is then wrapped and cut into sticks 82 having a stick length 84.

FIG. 3 shows a schematic top view of the sheet 70 having a crimped surface 72 according to the invention where gathering and forming a rod 80 and cutting the rod 80 into sticks 82 is indicated.

When the sheet 70 of material is pressed on the counter second roller 21, 61 by the first crimping roller 11, 51 having corrugations 17, 57 with a ridge-and-trough pattern, the ridges press on the sheet 70 and create bending lines that are lines of compressed areas of the material, and not lines of overextended areas of material. Compressed areas are less likely to shredding. By preventing shredding, the crimping according to the invention is much prone to product consistency and positive experiences than usual crimping process.

Figure 7:
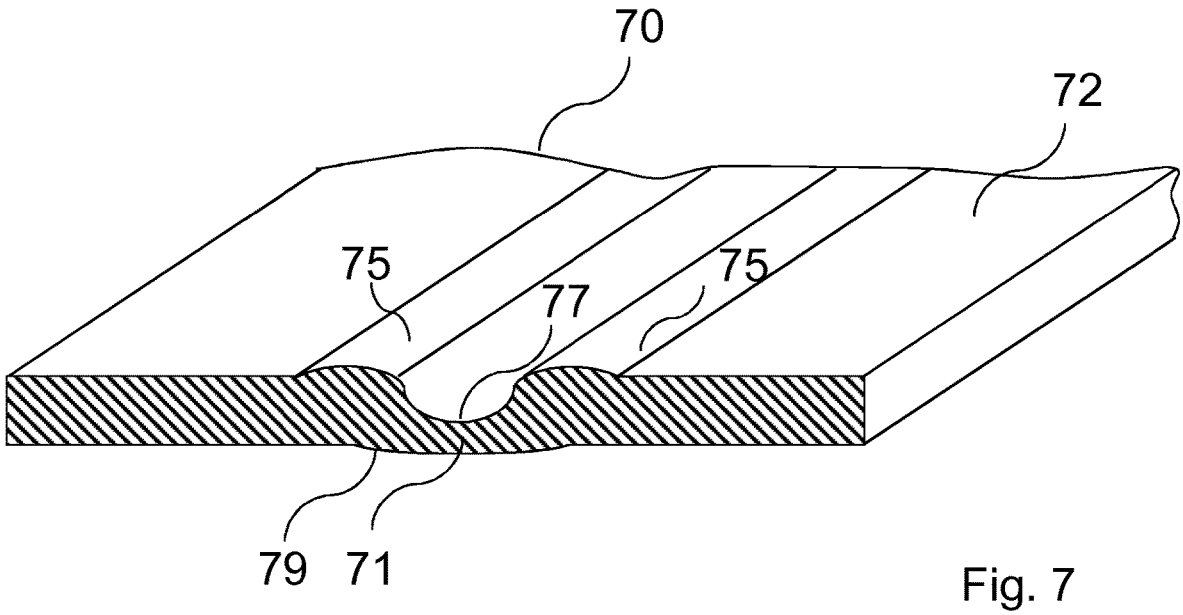
FIG. 7 shows a detail of a sheet of material crimped with a combination of corrugated and smooth rollers according to the invention.

In FIG. 7 a detail of a crimped sheet 70 of material is depicted which has been crimped with a combination of corrugated 11, 51 and smooth rollers 21, 31, or helical roller 61 according to the invention.

The crimping process of the sheet 70 between the ridges and troughs of the first roller 11, 51 on top of the sheet 70 and the smooth and soft surface of the second roller 21, 31, 61 on the bottom of the sheet 70 create bending lines 77 in the surface 72, where only one is depicted in the figure, that are made of compressed material 71 of the sheet 70 and which are thinner than the overall thickness of the sheet 70.

Slight bumps 79 at the backside of the thin bending lines 77 are created by the deformation of the soft surface of the second roller 21, 31, 61 under the pressure exerted by the ridges on the sheet 70 transmitted by the compressed material 71 on the soft surface of the second roller 21, 31, 61. On each side of the compressed material 71, other slight bumps 75 of material can be generated by the pressure, depending of the nature of the material, in particular depending on how compression spreads sideways into it and its plastic deformation ability.

Due to their compressed nature, the thin bending lines 77 are more resilient versus tearing than over-extend bending lines created by conventional crimping rollers in a conventional crimping process.

In case of the embodiment of FIG. 8, if the top soft layer is harder than the rubber layer under it, then the bump 79 will be less localized under the pressing ridge of the first roller 11.

Figure 11:
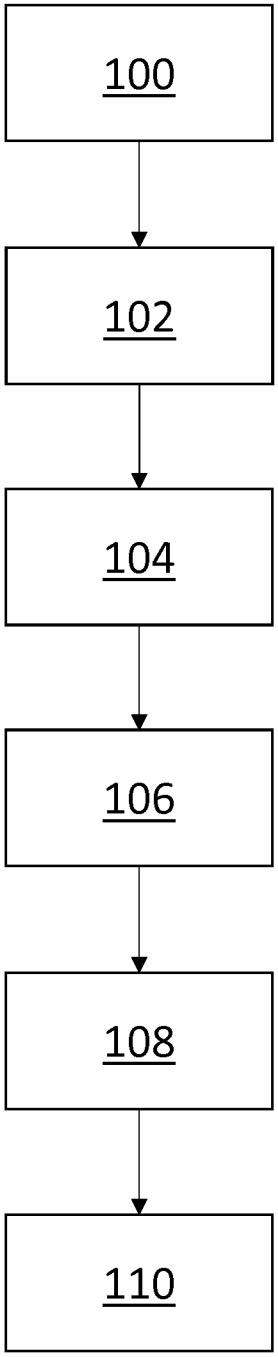
FIG. 11 shows a flow chart of a method for crimping a sheet of material according to the invention.

FIG. 11 shows a flow chart of a method for crimping a sheet of material according to the invention.

In a first step 100 a substantially continuous sheet of material 70 is fed to a set of crimping rollers in a transport direction 1. The set of rollers comprises a first roller 11, 51 and a second roller 21, 31, 61. The first roller is corrugated across at least a portion of its width.

The surface of the second roller is formed at least for a portion thereof in a material having an hardness lower than the hardness of a surface of the first roller.

In step 102 the substantially continuous sheet of material 70 is crimped to form the crimped sheet by feeding the substantially continuous sheet between the first and second rollers in the transport direction of the sheet such that the corrugations of the first roller apply a plurality crimp corrugations to the substantially continuous sheet.

In step 104, the crimped sheet of material is gathered, and a continuous rod 80 is formed using the crimped sheet of material in step 106. In step 108, the continuous rod is wrapped, e.g. in cigarette paper.

In step 110, the continuous wrapped rod is cut the continuous rod 80 into a plurality of rod-shaped components (sticks) 84, each rod-shaped component having a gathered crimped sheet formed from a cut portion of the crimped sheet, the crimp corrugations of the crimped sheet defining a plurality of channels in the rod-shaped component.

The invention claimed is:

1. A method of manufacturing a crimped sheet of material for an aerosol-generating article, the method comprising the steps of:

feeding a substantially continuous sheet of material to a set of crimping rollers in a transport direction, the set of crimping rollers comprising a first roller having a first surface and having a first plurality of ridges across at least a portion of its width and a second roller having a second surface, the second surface being formed at least for a portion thereof in a material having a hardness lower than the hardness of a material forming the first surface;

creating a plurality of substantially parallel ridges formed from alternating peaks and troughs joined by corrugation flanks in the substantially continuous sheet by crimping the substantially continuous sheet of material to form a crimped sheet by feeding the substantially continuous sheet between the first and second rollers in the transport direction of the sheet such that the first plurality of ridges of the first roller applies a plurality of crimp corrugations to the substantially continuous sheet;

gathering the crimped sheet;

forming a rod using the gathered crimped sheet;

wrapping the rod; and cutting the continuous rod into a plurality of rod-shaped components, each rod-shaped component having a gathered crimped sheet formed from a cut portion of the crimped sheet, the crimp corrugations of the crimped sheet defining a plurality of channels in the rod-shaped component.

2. The method according to claim 1, wherein the portion of the first surface of the first roller is realized in metal.

3. The method according to claim 1, wherein the portion of the second surface of the second roller is realized in rubber.

4. The method according to claim 3, wherein the second surface of the second roller includes a portion realized in metal and a portion realized in rubber.

5. The method according to claim 1, including the step of coating the second surface of the second roller with a first layer of a material having a first hardness and coating the first layer with a second layer of material having a second hardness.

6. The method according to claim 1, wherein the second roller has a smooth second surface.

7. The method according to claim 1, wherein the second roller includes a plurality of helical ridges.

8. The method according to claim 1, wherein the sheet of material is one of: a homogenized tobacco sheet, a plastic sheet or a sheet including cellulose.

9. The method according to claim 1, wherein the hardness of a portion of the first surface of the first roller is comprised between about 48 HRC and about 58 HRC.

10. The method according to claim 1, wherein the hardness of a portion of the second surface of the second roller is comprised between about 70 and about 94 SHORE A at 25 degree Celsius.

11. Method according to claim 1, including selecting a distance between the first and the second roller depending on the material of the sheet.

12. The method according to claim 1, wherein a second plurality of ridges is realized on the second surface.

13. A method of manufacturing a crimped sheet of material for an aerosol-generating article, the method comprising the steps of:

feeding a substantially continuous sheet of material to a set of crimping rollers in a transport direction, the set of crimping rollers comprising a first roller having a first surface and having a first plurality of ridges across at least a portion of its width and a second roller having a second surface, the second surface being formed at least for a portion thereof in a material having a hardness lower than the hardness of a material forming the first surface;

creating a plurality of substantially parallel ridges formed from alternating peaks and trough joined by corrugation flanks in the substantially continuous sheet by crimping the substantially continuous sheet of material to form the crimped sheet by feeding the substantially continuous sheet between the first and second rollers in the transport direction of the sheet such that the first plurality of ridges of the first roller applies a plurality of crimp corrugations to the substantially continuous sheet; and coating the second surface of the second roller with a first layer of a material having a first hardness and coating the first layer with a second layer of material having a second hardness.

14. A method of manufacturing a crimped sheet of material for an aerosol-generating article, the method comprising the steps of:

feeding a substantially continuous sheet of material to a set of crimping rollers in a transport direction, the set of crimping rollers comprising a first roller having a first surface and having a first plurality of ridges across at least a portion of its width and a second roller having a second surface, the second surface being formed at least for a portion thereof in a material having an hardness lower than the hardness of a material forming the first surface, a second plurality of ridges being realized on the second surface;

crimping the substantially continuous sheet of material to form the crimped sheet by feeding the substantially continuous sheet between the first and second rollers in the transport direction of the sheet such that the first plurality of ridges of the first roller applies a plurality of crimp corrugations to the substantially continuous sheet.

15. The method according to claim 14, wherein the portion of the first surface of the first roller is realized in metal.

16. The method according to claim 14, wherein the portion of the second surface of the second roller is realized in rubber.

17. The method according to claim 14, wherein the second plurality of ridges includes a plurality of helical ridges.

18. The method according to claim 14, wherein the sheet of material is a homogenized tobacco sheet.

* * * * *